US005247914A

United States Patent [19]

Imai et al.

[11] Patent Number: 5,247,914

[45] Date of Patent: Sep. 28, 1993

[54] INTAKE- AND/OR EXHAUST-VALVE TIMING CONTROL SYSTEM FOR INTERNAL COMBUSTION ENGINES

[75] Inventors: Hiroaki Imai; Masaharu Saito; Katsuhiko Uchida; Ikuo Misumi; Seija Suga, all of Kanagawa, Japan

[73] Assignee: Atsugi Unisia Corporation, Japan

[21] Appl. No.: 888,649

[22] Filed: May 27, 1992

[30] Foreign Application Priority Data

May 29, 1991 [JP] Japan ..... 3-38597[U]

[51] Int. Cl.[5] ..... F01L 1/34

[52] U.S. Cl. ..... 123/90.17; 123/90.31; 123/198 C; 464/2

[58] Field of Search ..... 123/90.12, 90.13, 90.15, 123/90.17, 90.31, 198 C, 196 R; 74/568 R, 567; 464/1, 2, 160

[56] References Cited

U.S. PATENT DOCUMENTS 4,231,330 11/1980 Garcea ..... 123/90.15
4,531,485 7/1985 Murther ..... 123/198 C
4,535,731 8/1985 Banfi ..... 123/90.15
4,648,363 3/1987 Kronich ..... 123/198 C
5,085,181 2/1992 Feuling ..... 123/90.15

FOREIGN PATENT DOCUMENTS 245408 10/1990 Japan ..... 123/90.17
3628 3/1991 PCT Int'l Appl. ..... 123/90.17

*Primary Examiner*—Willis R. Wolfe
*Assistant Examiner*—Weilun Lo
*Attorney, Agent, or Firm*—Ronald P. Kananen

[57] ABSTRACT

A variable intake- and/or exhaust-valve timing control system for an internal combustion engine comprises a cam sprocket having a driven connection with an engine crankshaft, a camshaft, a ring gear provided between the camshaft and the cam sprocket for adjusting a relative phase angle between the cam sprocket and the camshaft, and a ring gear drive mechanism for drivingly controlling the ring gear via fluid pressure created by an engine oil pump, depending upon the operating state of the engine. The drive mechanism includes a subsidiary oil pump for supplying a fluid pressure greater than a designated pressure level to the ring gear, during low engine speed and high engine load.

4 Claims, 2 Drawing Sheets

INTAKE- AND/OR EXHAUST-VALVE TIMING CONTROL SYSTEM FOR INTERNAL COMBUSTION ENGINES

BACKGROUND OF THE INVENTION

1. Field of the Invention

The present invention relates to an intake and/or exhaust-valve timing control system which is optimally adapted for use in internal combustion engines, and specifically to a system which is variably capable of controlling intake- and/or exhaust-valve timing depending upon the operating state of the engine, for example, the magnitude of engine load and/or engine speed.

2. Description of the Prior Disclosure

Recently, there have been proposed and developed various intake and/or exhaust-valve timing control systems for internal combustion engines for generating optimal engine performance according to the operating state of a vehicular engine.

As is generally known, valve timing is usually determined such that optimal engine performance s obtained; however, a predetermined valve timing is not suitable under all operating conditions. For example, when an engine is operating within a range of low engine revolutions, higher torque will be obtained with an intake-valve timing earlier than a fixed, predetermined valve timing.

Such conventional intake- and/or exhaust-valve timing control systems for internal combustion engine have been disclosed in U.S. Pat. Nos. 4,231,330 and 4,535,731. In these conventional valve timing control systems, a cam sprocket is rotatably supported through a ring gear mechanism by the front end of a camshaft. The ring gear mechanism includes a ring gear having an inner toothed portion engaging another toothed portion formed on the front end of the camshaft and an outer toothed portion engaging an inner toothed portion formed on the inner peripheral wall of the cam sprocket. In this manner, the ring gear rotatably engages between the cam sprocket and the camshaft. The ring gear is normally biased in the axial direction of the camshaft by means of a return spring, such as a coil spring. At least one of the two meshing pairs of gears is helical. The result is that axial sliding movement of the ring gear relative to the camshaft causes the camshaft to rotate about the cam sprocket and therefore the phase angle between the camshaft and the cam sprocket (and consequently, the phase angle between the camshaft and the engine crankshaft) is relatively varied. The ring gear moves, as soon as one of the two opposing forces acting on it, namely the preloading pressure of the above spring means or the oil pressure applied from the oil pump to the ring gear, exceeds the other. In the previously noted conventional valve timing control systems, a hydraulic circuit which serves as a ring gear driving hydraulic circuit, functions to feed a controllable oil pressure to a pressure chamber defined at the one end of the ring gear, and to feed an engine lubricating oil for lubricating rotational friction surfaces between a cylinder head, a bearing member, and a camshaft journaled by the cylinder head and the bearing member, and in addition to feed working fluid for operating a hydraulically operated valve lifter. In other words, a single hydraulic circuit is commonly utilized to provide the axial sliding movement of the ring gear, and to lubricate the friction surfaces between the camshaft, the cylinder head and the bearing member, and in addition to operate the valve lifter.

In this construction of the conventional variable valve timing control system, since a portion of working fluid discharged from the oil pump must be used for lubricating the rotational friction surfaces, even during low engine revolutions, wherein the working fluid pressure discharged from the oil pump is relatively low, a sufficient amount of working fluid is not supplied for the ring gear driving hydraulic circuit for the variable valve timing control system, during low engine speed and high engine load. Under this condition, since the hydraulic pressure supplied in the fluid cannot sufficiently overcome the biasing force caused by the return spring with the result that the ring gear is not quickly moved against the spring force but moderately moved according to a relatively low working fluid pressure. During low engine speed and high engine load, quick, axial sliding movement of the ring gear is prevented due to a low working fluid pressure supplied to the pressure chamber. Consequently, a prior art variable valve timing control system tends to exhibit a low step-response with regard to an intake- and/or exhaust-valve timing control executed by a variable valve timing control system, during low engine speed and high engine load.

SUMMARY OF THE INVENTION

It is, therefore, in view of the above disadvantages, an object of the present invention to provide an intake- and/or exhaust-valve timing control system for internal combustion engines, which can provide a high step-response of an intake and/or exhaust-valve timing control, even during low engine speed and high engine load.

It is another object of the invention to provide an intake and/or exhaust-valve timing control system for internal combustion engines, which can provide a high step-response of an intake and/or exhaust-valve timing control over all operating states of the engine.

In order to accomplish the aforementioned and other objects, a variable intake and/or exhaust valve timing control system for an internal combustion engine comprises an engine synchronous rotating member having a driven connection with an engine crankshaft, a camshaft receiving torque transmitted from the rotating member for opening and closing an intake- and/or exhaust-valve, a phase-angle adjusting mechanism for adjusting a relative phase angle between the rotating member and the camshaft, and a drive mechanism for drivingly controlling the phase-angle adjusting mechanism via fluid pressure created by a main oil pump employed in the engine, depending upon the operating state of the engine. The drive mechanism includes a subsidiary oil pump for supplying a fluid pressure greater than a designated pressure level to the phase-angle adjusting mechanism, during low engine speed and high engine load. The variable valve timing control system further comprises a controller for controlling the drive mechanism on the basis of signals detected by a crank angle sensor for monitoring a crank angle of the engine crankshaft and an air flow meter for monitoring an amount of intake air introduced through an engine air cleaner. The controller controls the drive mechanism to drive the subsidiary oil pump during low engine speed and high engine load, so as to generate the fluid pressure greater than the designated pressure level.

According to another aspect of the invention, a variable intake- and/or exhaust-valve timing control system for an internal combustion engine comprises an engine synchronous rotating member having a driven connection with an engine crankshaft, a camshaft receiving torque transmitted from the rotating member for opening and closing an intake- and/or exhaust-valve, a phase-angle adjusting mechanism for adjusting a relative phase angle between the rotating member and the camshaft, a drive mechanism for drivingly controlling the phase-angle adjusting mechanism via fluid pressure created by a main oil pump arranged in a hydraulic circuit, depending upon the operating state of the engine, the drive mechanism including a subsidiary oil pump being arranged in the hydraulic circuit in parallel with the main oil pump, for maintaining the fluid pressure at a designated high level during low engine speed and high engine load, and switching means for introducing one of a working fluid discharged from the main oil pump and a working fluid discharged from the subsidiary oil pump, into the phase-angle adjusting mechanism. The switching means introduces the working fluid discharged from the subsidiary oil pump, into the phase-angle adjusting mechanism, only during low engine speed and high engine load and introduces the working fluid discharged from the main oil pump into the phase-angle adjusting mechanism during medium and high engine speeds.

According to a further aspect of the invention, a variable intake- and/or exhaust-valve timing control system for an internal combustion engine comprises an engine synchronous rotating member having a driven connection with an engine crankshaft, a camshaft receiving torque transmitted from the rotating member for opening and closing an intake- and/or exhaust-valve, a phase-angle adjusting mechanism for adjusting a relative phase angle between the rotating member and the camshaft, a drive mechanism for drivingly controlling the phase-angle adjusting mechanism via fluid pressure created by a main oil pump employed in the engine, depending upon the operating state of the engine, the drive mechanism including a subsidiary oil pump being arranged in the hydraulic circuit in series to the main oil pump, for enhancing a pressure of working fluid discharged from the main oil pump. The variable valve timing control system further comprises valve means for draining working fluid in the hydraulic circuit during low engine load and for introducing pressurized working fluid discharged from the main oil pump into the subsidiary oil pump during high engine load. The valve means includes a two-position spool valve being operable in two positions, namely a first position in which the working fluid in the hydraulic circuit is drained, and a second position in which the pressurized working fluid discharged from the main oil pump is supplied through the hydraulic circuit to the subsidiary oil pump.

DESCRIPTION OF THE PREFERRED EMBODIMENTS

Figure 1:
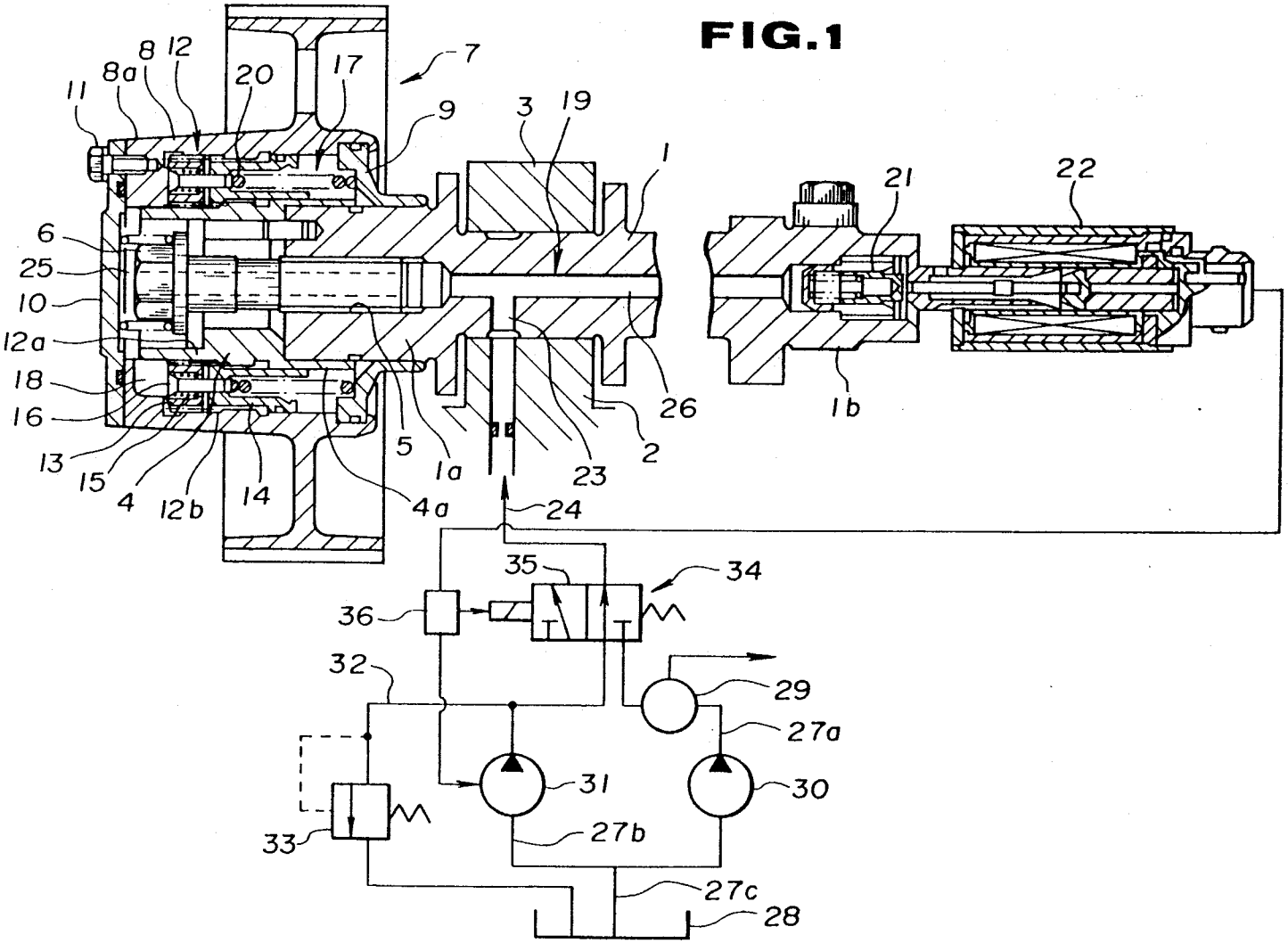
FIG. 1 is a longitudinal cross-sectional view illustrating a first embodiment of an intake- and/or exhaust-valve timing control system for internal combustion engines according to the invention.

Referring now to the drawings, particularly to FIG. 1, there is shown an intake and/or exhaust-valve timing control system applied for a DOHC engine with double camshafts over each line of cylinders. FIG. 1 shows a longitudinal cross-section of a camshaft 1 provided for opening and closing an intake and/or exhaust-valve (not shown). As clearly seen in FIG. 1, the camshaft is journaled by means of a cylinder head 2 and a bearing member 3. Reference numeral 7 denotes a substantially cylindrical timing belt pulley including a timing belt driven by a timing belt for transmitting torque from an engine crankshaft (not shown). The timing belt pulley and the camshaft 1 are coaxially arranged with respect to each other. The timing belt pulley 7 includes an essentially cylindrical section 8 in addition to the rotational timing belt pulley. The cylindrical section 8 employs a relatively long inner toothed portion at the inner peripheral surface thereof. The timing belt pulley 7 is hermetically closed by a front lid 10 attached to the front end 8*a* of the substantially annular hub thereof in a fluid-tight fashion, by means of bolts 11. A sleeve 4 having an outer toothed portion is firmly connected to the outer peripheral surface of a front end 1*a* of the camshaft 1 through its thin cylindrical hollow end 4*a* by means of a bolt 6 screwed into a threaded portion 5. A ring gear mechanism 12 is provided between the timing belt pulley 7 and the sleeve 4. The ring gear mechanism 12 includes a ring gear member being comprised of first and second ring gear elements 13 and 14, a plurality of connecting pins 16, and an annular rubber bushing or a plurality of coil springs 15. The first and second ring gear elements 13 and 14 are formed in such a manner as to divide a relatively long ring gear, including inner and outer toothed portions 12*a* and 12*b* into two ring gear elements. The inner and outer toothed portions 12*a* and 12*b* are respectively meshed with the outer toothed portion of the sleeve 4 and the inner toothed portion of the timing belt pulley 7. At least one of two meshing pairs of teeth is helical to provide axial sliding movement of the ring gear 12 relative to the camshaft 1. The forward movement (viewing FIG. 1) of the ring gear 12 is restricted by an inner shoulder of the inner periphery of the pulley 7 in such a manner that the front end of the first ring gear element 13 abuts the inner shoulder of the pulley 7. On the other hand, the axially backward movement of the ring gear 12 is restricted by the front end of a substantially annular retainer 9 which is fixed on the rear end of the hub of the pulley 7 by caulking. An annular pressure chamber 18 is defined by the inner peripheral surface of the pulley 7, the outer peripheral surface of the sleeve 4, and the front end surface of the first ring gear element 13 for introducing pressurized working fluid fed from an oil pan 28 via an hydraulic oil pump hereinbelow described in detail.

A ring gear drive mechanism 17 for the previously described ring gear 12 comprises a hydraulic circuit 19 for supplying and draining the pressurized working fluid from the oil pan 28 to the pressure chamber 18, a compression spring 20 disposed between the second ring gear element 14 and the retainer 9 for normally biasing the ring gear member 12 in an axially forward direction (viewing FIG. 1). In addition to the above, the ring gear drive mechanism 17 includes a fluid flow control valve 21 coaxially arranged at the rear end 1*b* of the camshaft 1 for controlling fluid flow rate of working fluid supplied to the pressure chamber 18 and an electromagnetic actuator 22 mounted on the cylinder head for opening and closing the flow control valve 21 depending on the operating state of the engine. The electromagnetic actuator 22 is so designed as to fully open the flow control valve 21 during low engine load and to close the flow control valve 21 during high engine load. The hydraulic circuit 19 includes a radially extending fluid passage 23 bored in the front journaled section of the camshaft 1, a fluid passage 24 penetrating in the cylinder head 2 and exposing to the radial fluid passage 23, a working fluid chamber 25 defined between the front end of the sleeve 4 and the inner wall of the front lid 10, and an axially extending fluid passage 26 communicated through the axially extending center bore of the bolt 6 and the fluid chamber 25 with the pressure chamber 18. The axial fluid passage 26 is also connected to the radial fluid passage 23 and in addition to the flow control valve 21.

The variable valve timing control system according to the invention also includes a pair of branched fluid passages 27*a* and 27*b* juxtaposed to each other, each fluid passage communicated through a directional control mechanism 34 including a three-ports; two-position electromagnetic directional control valve 35 with the fluid passage 24. The branched fluid passages 27*a* and 27*b* are converged at a single fluid flow line 27*c* connected to the oil pan 28. As appreciated from FIG. 1, the variable valve timing control system according to the invention includes two different pressurized working fluid pressure sources 30 and 31, one being a main oil pump 30, such as an ordinary engine oil pump, disposed in the branched fluid passage 27*a* for supplying a portion of working fluid through a main oil gallery 29 so as to lubricate rotational friction surfaces between the cylinder head 2, bearing member 3, and the journaled section of the camshaft 1, and the other being a subsidiary oil pump 31 disposed in the branched fluid passage 27*b* so as to supply working fluid pressurized via the hydraulic circuit 19 only to the pressure chamber 18. The subsidiary oil pump 31 may be driven by a DC motor (not shown). A relief valve 33 is disposed in a relief line 32 provided upstream of the subsidiary oil pump 31, so as to control the pressure of working fluid to be fed to the directional control valve 35 at a designated constant pressure value.

The directional control mechanism 34 includes an electronic controller 36 for switching the directional control valve from one position to the other position, depending on the operating state of the engine, particularly engine revolutions. The controller 36 includes a micro-computer for deriving the current operating state of the engine on the basis of signals monitored by various sensors, such as a crank angle sensor for monitoring the crank angle of the engine crankshaft, and an air flow meter for monitoring the amount of intake air introduced through the ar cleaner. The controller 36 suitably outputs control signals respectively to the electromagnetic actuator 22, the electromagnetic directional control valve 35, and the DC motor for the subsidiary oil pump 31.

The variable valve timing control system of the first embodiment operates as follows.

During idling or low engine speed and low engine load, the controller 36 generates control signals, having for example a zero duty cycle, to both the electromagnetic actuator 22 and the electromagnetic directional control valve 35 and generates a control signal, having for example a 100% duty cycle, to the subsidiary oil pump 31. As a result, the fluid flow control valve 21 is kept in an open state shown in FIG. 1, since the electromagnetic actuator 22 is de-energized by the control signal having the zero duty cycle and the directional control valve 35 is kept in a position shown in FIG. 1, so as to establish a fluid communication between the fluid passage 24 and the branched fluid passage 27*b* and to block a fluid communication between the fluid passage 24 and the branched fluid passage 27*a*. In addition to the above, the subsidiary oil pump 31 is rotated by the energized DC motor. Therefore, during low engine speed and low engine load, all of the hydraulic oil discharged from the main oil pump 30 s supplied to the previously noted rotational friction surfaces, thereby providing a sufficient lubrication therefor. On the other hand, all of the working fluid discharged from the subsidiary oil pump 31 is exhausted through the fluid passage 24, the radial fluid passage 23, the axial fluid passage 26, and the fully opened flow control valve 21 to the interior of the cylinder head 2. In this manner, the pressurized working fluid is not supplied towards the pressure chamber 18, due to the fully opened flow control valve 21, with the result that a fluid pressure in the pressure chamber 18 is kept in a low pressure state and consequently the ring gear member 12 is kept in the leftmost position (viewing FIG. 1) by means of the spring 20. Thus, the relative phase angle between the timing belt pulley 7 and the camshaft 1 is set to a predetermined phase angle in which intake and/or exhaust-valve timing relative to the crank angle is initialized. Under this condition, the timings of intake-valve opening and closing are in general retarded in relation to the piston position, thereby resulting in a high charging efficiency of an air-fuel mixture introduced through the intake-valve to the combustion chamber of the engine, due to the inertia of fluid mass of the introduced mixture. In this manner, the intake-and/or exhaust-valve timing is variably controlled depending on the operating state of the engine. During transition from a high engine load to a low engine load, since the working fluid pressure in the pressure chamber 18 is rapidly and smoothly reduced through the previously noted fluid drain path directed through the fluid passage 24, the radial fluid passage 23, the axial fluid passage 26, and the flow control valve 21 to the interior of the cylinder head 2, the valve timing control can be executed with a high step-response. In addition, a sufficient amount of lubricating oil is continuously supplied from the main oil pump 30 through the main oil gallery 29 to the slight aperture defined between the outer peripheral surface of the camshaft 1, and the semi-circular inner peripheral surfaces of the cylinder head 2 and the bearing member 3. As appreciated from the above, the variable valve timing control system according to the invention can provide a sufficient lubricating action and a high step-response of the valve timing control during low engine speed and low engine load.

When the operating state of the engine is shifted from low engine speed low engine load to low engine speed and high engine load, the controller subsequently generates a control signal having a zero duty cycle to the directional control valve 35 and generates control signals having a 100% duty cycle to the electromagnetic actuator 22 and the DC motor for the subsidiary oil pump 31. That is, only the electromagnetic actuator 22 is shifted from the OFF state (shown in FIG. 1) to the ON state, with the result that the flow control valve 21 is shifted from the fully open state to the fully closed state. Therefore, all of the amount of working fluid discharged from the subsidiary oil pump 31 is fed through the radial fluid passage, the axial fluid passage 26, and the working fluid chamber 25 to the pressure chamber 18, in that order, and as a result the working fluid pressure in the pressure chamber 18 is rapidly increased. Therefore, the ring gear is moved in the rightmost position against the biasing force created by the spring 20, with the result that the relative phase angle between the timing belt pulley 7 and the camshaft 1 is changed to a predetermined phase angle which corresponds to an optimal phase angle during high engine load. Under this condition, the timings of intake-valve opening and closing are advanced in relation to the piston position in the cylinder, thereby resulting in a high combustion efficiency. That is, during low engine speed, irrespective of high or low engine load, since pressurized working fluid for hydraulically operating the valve timing control system is not supplied through the main oil pump 30, such as the engine oil pump, but through the subsidiary oil pump 31, a sufficient amount of working fluid and a sufficient working fluid pressure can be reliably supplied to the pressure chamber 18 by means of the subsidiary oil pump 31. Therefore, even during low engine speed and high engine load, the pressure in the pressure chamber 18 can be rapidly and smoothly increased and as a result the axial sliding movement of the ring gear can be quickly achieved. This permits a desired relative angular displacement between the camshaft 1 and the timing belt pulley 7 with a high step-response of the valve timing control. As set forth above, since the working fluid pressure in the pressure chamber 18 is quickly increased by means of the subsidiary oil pump 31 even during low engine speed and high engine load, a preloading pressure of the compression spring 20 may be set at a relatively great value. This enhances a step-response with regard to the valve timing control during transition from high engine load to low engine load.

Although the flow rate of working fluid discharged from the subsidiary oil pump 31 is generally set to a lower level than that discharged from the main oil pump 30, the flow rate of working fluid from the subsidiary oil pump 31 may be set to exceed that of the main oil pump 30. This may result in an extremely high step-response of the valve timing control during transition from low engine speed and low engine load to low engine speed and high engine load.

On the other hand, when the operating state of the engine is shifted from low engine speed to medium engine speed, the controller 36 generates a control signal having a 100% duty cycle to, directional control valve 35 so as to establish a fluid communication between the fluid passage 24 and the branched fluid passage 27*a* and to block a fluid communication between the fluid passage 24 and the branched fluid passage 27*b*, and generates a control signal having a zero duty cycle to the drive motor for the subsidiary oil pump 31 so as to de-energize the drive motor and to stop the subsidiary oil pump 31. Under these conditions, the working fluid discharged from only the main oil pump 30 is distributed to the slight aperture defined between the outer peripheral surface of the camshaft 1, and the semicircular inner peripheral surfaces of the cylinder head 2 and the bearing member 3, and to the pressure chamber 18 for the valve control system. During medium engine speed, the main oil pump 30 can provide pressurized working fluid having a high pressure sufficient to cause quick axial sliding movement of the ring gear. Furthermore, since the operation of the subsidiary oil pump 31 is quickly stopped, an undesirable energy loss is avoided.

Figure 2:
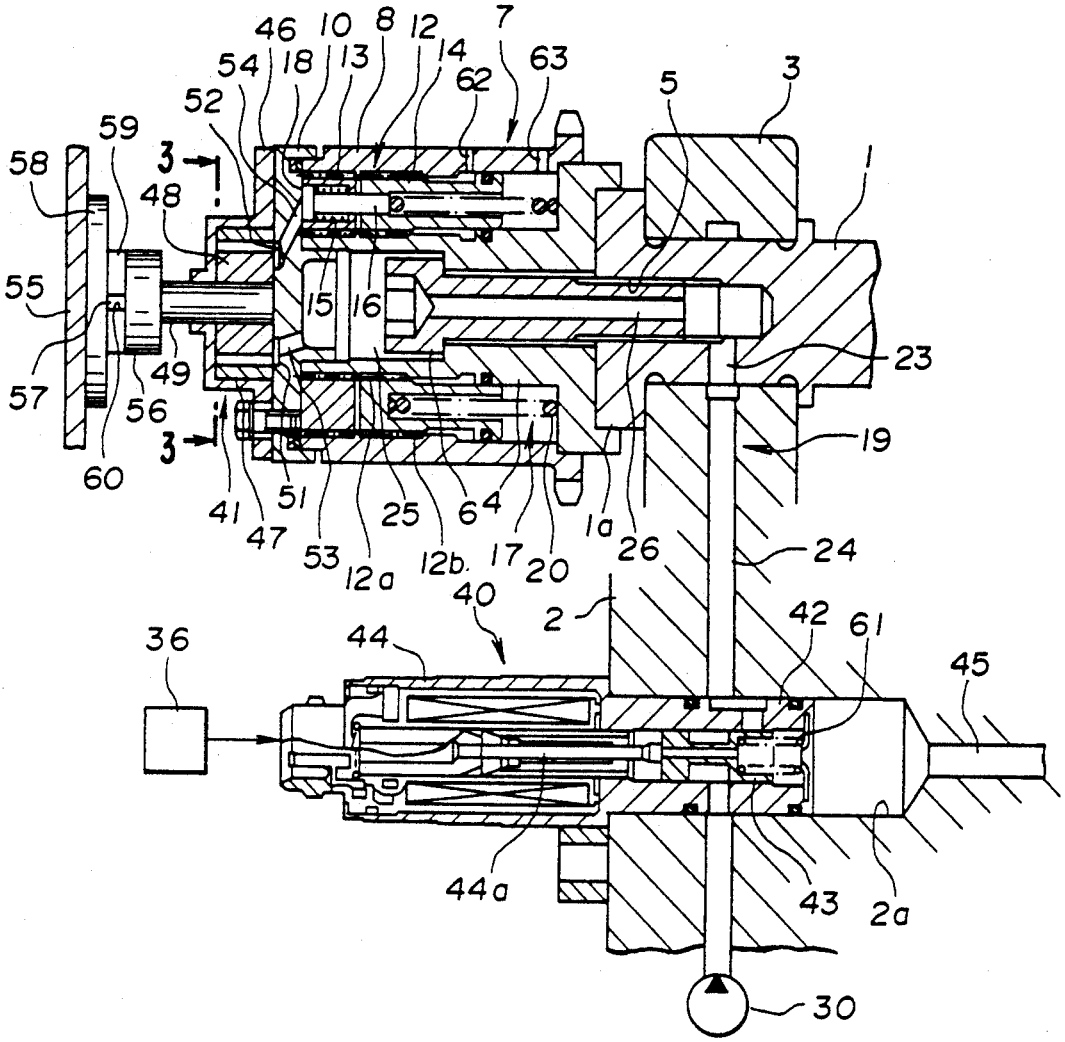
FIG. 2 is a longitudinal cross-sectional view illustrating a second embodiment of an intake-and/or exhaust-valve timing control system for internal combustion engines according to the invention.
Figure 3:
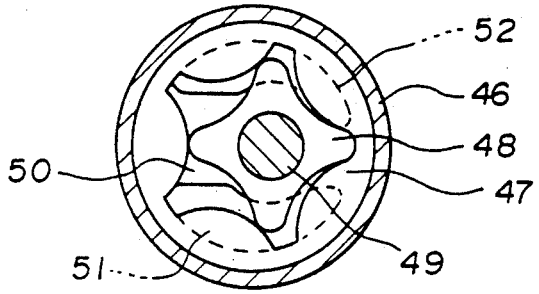
FIG. 3 is a lateral cross-sectional view taken along of line 3—3 of FIG. 2.

Referring now to FIGS. 2 and 3, there is shown a second embodiment of an intake and/or exhaust-valve timing control system for internal combustion engines. FIG. 2 shows a longitudinal cross-section of the front section of the camshaft 1. Since the valve timing control system of the second embodiment is basically similar to the first embodiment, the same reference numerals used in the first embodiment of FIG. 1 will be applied to the corresponding elements used in the second embodiment of FIGS. 2 and 3. The second embodiment of FIGS. 2 and 3 is different from the first embodiment of FIG. 1 in that the timing belt pulley 7 is replaced with the cam sprocket 7, the branched fluid passages 27*a* and 27*b* are not provided, the main oil pump 30 is provided downstream of the fluid passage 24, a directional control valve 40 is disposed in the fluid passage 24 upstream of the main oil pump 30, and in addition an auxiliary or subsidiary oil pump 41 is provided between the axial fluid passage 26 and the pressure chamber 18.

The directional control valve 40 includes a valve body 42 whose cylindrical extension is press-fitted into a bore 2*a* formed in the cylinder head 2, a spool valve 43 slidably enclosed in the cylindrical extension of the valve body 42, and an electromagnetic actuator 44 for actuating the spool valve 43, and a return spring 61 normally biasing the spool valve leftwards (viewing FIG. 2). The spool valve 43 acts to establish a fluid communication between the fluid passage 24 and the outlet of the main oil pump 30 or to block the fluid communication between the fluid passage 24 and the outlet of the main oil pump 30, and to establish a fluid communication between the outlet of the main oil pump 30 and a drain passage 45, and to establish a fluid communication of the upstream section of the fluid passage 24 and the drain passage 45. The electromagnetic actuator 44 includes a plunger piston 44*a* firmly connected to one end of the spool valve 43 so as to cause the sliding movement of the spool valve 43. The actuator 44 is activated or deactivated on the basis of a control signal generated by the controller 36 as previously described.

In the second embodiment, during low engine load, the controller 36 generates a control signal having a zero duty cycle to the actuator 44 and therefore the actuator 44 is deactivated. As a result, the spool valve 43 is kept in the leftmost position shown in FIG. 2 in such a manner as to block the fluid communication between the upstream and downstream sections of the fluid passage 24, and to establish the fluid communication between the outlet of the main oil pump 30 and the drain passage 45, and to establish the fluid communication between the upstream section of the fluid passage 24 and the drain passage 45. On the other hand, during high engine load, the controller 36 generates a control signal having a 100% duty cycle and as a result the actuator is activated and thus the spool valve 43 is pushed by the plunger rod 44*a* rightwards against spring force caused by the return spring 61 and kept in the rightmost position in such a manner as to establish the fluid communication between the fluid passage 24 and the outlet of the main oil pump 30.

As clearly seen in FIGS. 2 and 3, in the second embodiment, a rotor-type oil pump, such as a trochoid pump is utilized as a subsidiary oil pump 41. The rotor-type oil pump 41 includes a pump body 46 firmly fixed onto the end plate 10, a substantially annular outer rotor 47 fixed onto the inner peripheral surface of the pump body 46, an inner rotor 48 operably enclosed in the inner space defined in the outer rotor 47, and a support shaft 49 firmly connected to the inner rotor 48 in such a manner as to penetrate a substantially center portion of the pump body 46. The outer rotor 47 of the trochoid pump 41 employs an inner toothed portion, while the inner rotor 48 employs an outer toothed portion, and thus these toothed portions are meshed with each other. As is generally known, the total number of teeth included in the inner toothed portion of the outer rotor 47 is incremented by one, when compared with the total number of teeth included in the outer toothed portion of the inner rotor 48. Furthermore, the center axis of the inner rotor 48 or the support shaft 49 is offset from the center axis of the outer rotor 47 by a predetermined distance. As seen in FIG. 3, the two rotors 47 and 48 are cooperative with each other so as to define therebetween a desired aperture 50 corresponding to a substantially one tooth. As illustrated in FIGS. 2 and 3, the rotor-type oil pump 41 employs a pair of substantially semi-circular ports 51 and 52 formed on the abutting surface of the end plate 10 hermetically abutting the opening end of the pump body 46. The port 51 serves as an intake port communicated through a working fluid intake passage 53 with the fluid passage 25, while the port 52 serves as a discharge port communicated through a working fluid discharge passage 54 with the pressure chamber 18.

Returning to FIG. 2, the rotational movement of the support shaft 49 is restricted by a timing chain cover 55. That is, the outermost end of the support shaft 49 is firmly connected to a disc plate 56 having a diametrically extending projecting portion 57 having a square in cross-section. On the other hand, the timing chain cover 55 employs a disc-shaped base plate 58 attached thereto. The base plate 58 employs a small disc-shaped restricting plate 59 having a groove 60 into which the projecting portion 57 is fitted. In other words, the timing chain cover 55 is coupled with the support shaft 49 through the members 56, 58 and 59. With this construction, during operation of the engine, the rotational movement of the inner rotor 48 is always restricted by means of the support shaft 49 coupled with the timing chain cover 55, while the outer rotor 47 is eccentrically rotated about the inner rotor 48 in accordance with rotational movement of the pump body 46 rotated together with the cam sprocket 7, so as to provide a designated pumping action. The valve timing control system of the second embodiment operates as follows.

During low engine load, the controller 36 generates a control signal having a zero duty cycle to the actuator 44, and thus the actuator is deactivated, thereby permitting the spool valve 43 to be kept in the leftmost position (viewing FIG. 2) by means of the spring 61. Therefore, the spool valve permits the fluid communication between the outlet of the main oil pump 30 and the drain passage 45 and the fluid communication between the upstream section of the fluid passage 24 and the drain passage 45, and blocks the fluid communication between the fluid passage 24 and the outlet of the engine oil pump 30. Such a fluid flow arrangement permits back-flow of working fluid in the hydraulic circuit 19, with the result that the working fluid in the pressure chamber 18 is rapidly drained through the above noted predetermined oil drain path and consequently the fluid pressure in the pressure chamber is smoothly decreased. In this manner, the ring gear 12 becomes moved in the leftmost position illustrated in FIG. 2. In this manner, the relative phase angle between the cam sprocket 7 and the camshaft 1 is set to the predetermined phase angle in which intake- and/or exhaust-valve timing relative to the crank angle is initialized. This results in a retarded timings of intake-valve opening and closing.

Conversely, when the operating state of the engine is shifted from the low engine load to the high engine load, the controller 36 generates a control signal having a 100% duty cycle to the actuator 44 so as to activate the latter. As a result, the spool valve 43 is moved rightwards against a spring force caused by the spring 61, thereby permitting the fluid communication between the outlet of the oil pump 30 and the fluid passage 24, and simultaneously blocking the fluid drain path. Therefore, the pressurized working fluid is supplied from the main oil pump 30 through the fluid passage 24, the radial fluid passage 23, the axial fluid passage 26, the fluid chamber 25, the intake passage 53, and the intake port 51 to the pump chamber of the subsidiary oil pump 41. In accordance with the rotational movement of the cam sprocket 7 having a driven connection with the engine crankshaft, the outer rotor 47 together with the pump body 46 is eccentrically rotated about the inner rotor 48, thereby causing a pumping action of the subsidiary oil pump 41. As a result, the working fluid introduced through the intake port 51 into the pump chamber is further pressurized by the pumping action of the subsidiary oil pump 41. That is, during high engine load, the pressure of working fluid discharged from the main oil pump 30 is enhanced by means of the subsidiary oil pump 41, and thus the enhanced fluid pressure of working fluid is fed through the discharge port 52 and the discharge passage 54 to the pressure chamber 18. Therefore, the pressure in the pressure chamber 18 is quickly and smoothly increased, with the result that the ring gear 12 is quickly moved rightwards against the spring force caused by the spring 20. As a result, the relative phase angle between the cam sprocket 7 and the camshaft 1 is changed to a predetermined phase angle corresponding to an optimal phase angle during high engine load, and thus the timings of intake-valve opening and closing are advanced in relation to the piston position in the cylinder. In the second embodiment, since the pressure of working fluid discharged from the main oil pump 30 is further increased by means of the subsidiary oil pump 41 and the further pressurized working fluid is introduced into the pressure chamber 18, the preloading pressure of the return spring 20 may be set at a relatively great value. This results in a higher step-response with regard to the variable valve timing control during transition from high engine load to low engine load.

In FIG. 2, reference numerals 62 and 63 respectively designate oil drain passages for smoothly draining working fluid leaked from the pressure chamber 18 along the inner and outer peripheries of the second ring gear element 14, when the actuator 44 is deactivated.

In the second embodiment, since the subsidiary oil pump 41, such as a rotary-type oil pump is attached onto the front end of the cam sprocket 7 and its pumping action is obtained by utilizing the rotational force of the cam sprocket 7, the entire construction of the valve timing control system according to the invention is simplified and in addition the oil supply passage arrangement from the main oil pump 30 via the intermediate fluid supply passage to the subsidiary oil pump 41 is simplified.

Although in the second embodiment, the rotational movement of the support shaft for the inner rotor of the rotor-type oil pump is restricted by the timing chain cover, and the outer rotor is driven about the inner rotor in the accordance with rotation of the cam sprocket, the support shaft for the inner rotor may be directly driven by means of an external driving unit, such as a driving motor.

Furthermore, although the trochoid pump is utilized as a subsidiary oil pump, another rotor type oil pump may be applied as a subsidiary oil pump.

Moreover, although the double oil pump system for the variable valve timing control system according to the invention is applied for a helical piston or ring gear type valve timing control system, the double oil pump system may be applied for a spring clutch type valve timing control system as disclosed in U.S. Pat. No. 5,056,479.

Although in the preferred embodiments, the ring gear is normally biased in an initial position by means of a compression spring, the ring gear may be biased by means of a fluid-operated actuator.

While the foregoing is a description of the preferred embodiments for carrying out the invention, it will be understood that the invention is not limited to the particular embodiment shown and described herein, but may include variations and modifications without departing from the scope or spirit of this invention as described by the following claims.

What is claimed is:

1. A variable intake- and/or exhaust-valve timing control system for an internal combustion engine comprising:

an engine synchronous rotating member having a driven connection with an engine crankshaft;

a camshaft receiving torque transmitted from said rotating member for opening and closing an intake and/or exhaust-valve;

a phase-angle adjusting mechanism for adjusting a relative phase angle between said rotating member and said camshaft;

a drive mechanism for drivingly controlling said phase-angle adjusting mechanism via fluid pressure created by a main oil pump arranged in a hydraulic circuit, depending upon the operating state of said engine; characterized by said drive mechanism including a subsidiary oil pump being arranged in said hydraulic circuit in parallel with said main oil pump, for maintaining said fluid pressure at a designated high level during low engine speed and high engine load, and switching means for introducing one of a working fluid discharged from said main oil pump and a working fluid discharged from said subsidiary oil pump, into said phase-angle adjusting mechanism.

2. The variable valve timing control system as set forth in claim 1 wherein said switching means introduces said working fluid discharged from said subsidiary oil pump, into said phase-angle adjusting mechanism, only during low engine speed and high engine load and introduces said working fluid discharged from said main oil pump, into said phase-angle adjusting mechanism during medium and high engine speeds.

3. A variable intake- and/or exhaust-valve timing control system for an internal combustion engine comprising:

an engine synchronous rotating member having a driven connection with an engine crankshaft;

a camshaft receiving torque transmitted from said rotating member for opening and closing an intake- and/or exhaust-valve;

a phase-angle adjusting mechanism for adjusting a relative phase angle between said rotating member and said camshaft;

a drive mechanism for drivingly controlling said phase-angle adjusting mechanism via fluid pressure created by a main oil pump arranged in a hydraulic circuit employed in said engine, depending on the operating state of said engine, said drive mechanism including a subsidiary oil pump being arranged in said hydraulic circuit in series to said main oil pump, for enhancing a pressure of working fluid discharged from said main oil pump; characterized by valve means for draining working fluid in said hydraulic circuit during low engine load and for introducing pressurized working fluid discharged from said main oil pump into said subsidiary oil pump during high engine load.

4. A variable intake- and/or exhaust-valve timing control system for an internal combustion engine comprising:

an engine synchronous rotating member having a driven connection with an engine crankshaft;

a camshaft receiving torque transmitted from said rotating member for opening and closing an intake- and/or exhaust-valve;

a phase-angle adjusting mechanism for adjusting a relative phase angle between said rotating member and said camshaft;

a drive mechanism for drivingly controlling said phase-angle adjusting mechanism via fluid pressure created by a main oil pump arranged in a hydraulic circuit employed in said engine, depending on the operating state of said engine, said drive mechanism including a subsidiary oil pump being arranged in said hydraulic circuit in series to said main oil pump, for enhancing a pressure of working fluid discharged from said main oil pump; characterized by valve means for draining working fluid in said hydraulic circuit during low engine load and for introducing pressurized working fluid discharged from said main oil pump into said subsidiary oil pump during high engine load; wherein said valve means includes a two-position spool valve being operable in two positions, namely a first position in which the working fluid in said hydraulic circuit is drained, and a second position in which the pressurized working fluid discharged from said main oil pump is supplied through said hydraulic circuit to said subsidiary oil pump.

* * * * *